United States Patent [19]

Williams et al.

[11] Patent Number: 4,908,882

[45] Date of Patent: Mar. 20, 1990

[54] PORTABLE SPITTOON

[76] Inventors: J. Greg Williams; J. Frankie Williams, both of P.O. box 1168, Pinson, Ala. 35126

[21] Appl. No.: 278,480

[22] Filed: Dec. 1, 1988

[51] Int. Cl.[4] ..... A61J 19/00

[52] U.S. Cl. ..... 4/261; 4/271; 4/285

[58] Field of Search ..... 4/258, 259, 261, 274, 4/267, 271, 283, 285

[56] References Cited

U.S. PATENT DOCUMENTS

| | | | |
|---|---|---|---|
| 863,445 | 8/1907 | Ray | 4/271 |
| 878,933 | 2/1908 | O'Dell et al. | 4/261 |
| 921,483 | 5/1909 | Thatcher | 4/261 |
| 994,352 | 6/1911 | Wells | 4/261 |
| 1,023,669 | 4/1912 | Megill | 4/258 |
| 1,025,288 | 5/1912 | Morey | 4/261 |
| 1,072,695 | 9/1913 | Brotherton | 4/259 |
| 1,091,418 | 3/1914 | Woodworth | 4/261 |
| 1,201,995 | 10/1916 | Adams | 4/272 |
| 4,162,547 | 7/1979 | Jenkins | 4/259 |

FOREIGN PATENT DOCUMENTS

| | | | |
|---|---|---|---|
| 379898 | 8/1923 | Fed. Rep. of Germany | 4/261 |
| 287873 | 8/1931 | Italy | 4/267 |

*Primary Examiner*—Henry J. Recla
*Assistant Examiner*—Edward C. Donovan
*Attorney, Agent, or Firm*—Jerry T. Kearns

[57] ABSTRACT

A portable spittoon includes a hollow body member having a top access opening disposed in an oblique plane. A pivotal cover is operated by a thumb tab. An annular shoulder is recessed within the access opening and engages a radially outwardly extending flange formed at an inlet opening of a frusto conical funnel. An outlet end of the funnel is suspended within the hollow body and has a downwardly curved end to direct spittle to a central interior floor portion of the hollow body member. A disposable plastic liner is received within the hollow body member and has an upper end edge clamped between the radial funnel flange and the annular recessed shoulder. A deodorant and disinfectant treated sponge is secured to a bottom floor portion of the liner and rests on the interior floor of the hollow body member. The spittoon includes a handle and is designed to dispose of tabacco chewers' spittle in a socially acceptable and sanitary fashion.

13 Claims, 3 Drawing Sheets

PORTABLE SPITTOON

BACKGROUND OF THE INVENTION

1. Field of the Invention

The present invention relates to spittoons, and more particularly pertains to portable spittoon for use by tobacco chewers. Individuals who chew tobacco have resorted to carrying cans, and empty beverage bottles and cups to dispose of spittle produced by chewing tobacco. Many individuals enjoy tobacco chewing at sporting events such as ball games. However, many individuals find such tobacco chewers' habit of expectorating into open topped containers to be distasteful and unsanitary. In order to enable tobacco chewers to dispose of their expectorate in a socially acceptable fashion, the present invention provides an enclosed portable spittoon which includes a sponge treated with deodorant and disinfectant.

2. Description of the Prior Art

Various types of spittoons are known in the prior art. A typical example of such a spittoon is to be found in U.S. Pat. No. 863,445, which issued to W. Ray on Aug. 13, 1907. This patent discloses a spittoon having a hinged lid actuated through a linkage by a foot pedal. The device includes a funnel for directing spittle into a central portion of the receptacle. U.S. Pat. No. 921,483, which issued to T. Thatcher on May 11, 1909, discloses a spittoon having a hollow receptacle with an outwardly flared upper end and surrounded by a reservoir containing a quantity of a disinfecting liquid. U.S. Pat. No. 994,352, which issued to W. Wells on June 6, 1911, discloses a spittoon having a receptacle with an inserted apertured funnel and having a hinged cover actuated through a linkage by a foot pedal. The device includes a cylinder mounted exteriorly of the receptacle and containing a quantity of a disinfectant which is communicated by a conduit to disinfect the interior of the receptacle. U.S. Pat. No. 1,072,695, which issued to W. Brotherton on Sept. 9, 1913, discloses a portable spittoon which has an oval body portion containing a quantity of absorbent material treated with a disinfectant. U.S. Pat. No. 1,201,995, which issued to R. Adams on Oct. 17, 1916, discloses a spittoon having a hinged cover actuated through a linkage by a foot pedal. The device includes a reservoir containing a quantity of a disinfecting liquid.

While the above mentioned devices are suited for their intended usage, none of these devices discloses a satisfactory portable spittoon which includes a disposable liner having a disinfectant treated sponge. Additional features of the present invention, not disclosed by the aforesaid prior art devices include the provision of an access opening disposed in an oblique plane and selectively closable by a pivotal thumb tab actuated cover. Inasmuch as the art is relatively crowded with respect to these various types of spittoons, it can be appreciated that there is a continuing need for and interest in improvements to such spittoons, and in this respect, the present invention addresses this need and interest.

SUMMARY OF THE INVENTION

In view of the foregoing disadvantages inherent in the known types of spittoons now present in the prior art, the present invention provides an improved portable spittoon. As such, the general purpose of the present invention, which will be described subsequently in greater detail, is to provide a new and improved portable spittoon which has all the advantages of the prior art spittoons and none of the disadvantages.

To attain this, representative embodiments of the concepts of the present invention are illustrated in the drawings and make use of a hollow body member having a top access opening disposed in an oblique plane. A pivotal cover is operated by a thumb tab. An annular shoulder is recessed within the access opening and engages a radially outwardly extending flange formed at an inlet opening of a frusto conical funnel. An outlet end of the funnel is suspended within the hollow body and has a downwardly curved end to direct spittle to a central interior floor portion of the hollow body member. A disposable plastic liner is received within the hollow body member and has an upper end edge clamped between the radial funnel flange and the annular recessed shoulder. A deodorant and disinfectant treated sponge is secured to a bottom floor portion of the liner and rests on the interior floor of the hollow body member. The spittoon includes a handle and is designed to dispose of tobacco chewers' spittle in a socially acceptable and sanitarY fashion.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable spittoon which has all the advantages of the prior art spittoons and none of the disadvantages.

It is another object of the present invention to provide a new and improved portable spittoon which may be easily and efficiently manufactured and marketed.

It is a further object of the present invention to provide a new and improved portable spittoon which is of a durable and reliable construction.

An even further object of the present invention is to provide a new and improved portable spittoon which is susceptible of a low cost of manufacture with regard to both materials and labor, and which accordingly is then susceptible of low prices of sale to the consuming public, thereby making such spittoons economically available to the buying public.

Still yet another object of the present invention is to provide a new and improved portable spittoon which provides in the apparatuses and methods of the prior art some of the advantages thereof, while simultaneously overcoming some of the disadvantages normally associated therewith.

Still another object of the present invention is to provide a new and improved portable spittoon for disposing of tobacco chewers' expectorate in a sanitary and socially acceptable fashion.

Yet another object of the present invention is to provide a new and improved portable spittoon which utilizes disposable liners containing a disinfectant treated sponge.

Even still another object of the present invention is to provide a new and improved portable spittoon which utilizes a specially configured receptacle with an access opening oriented in an oblique plane for convenient use by tobacco chewers.

An additional objective of the present invention is the provision of a portable spittoon having a removable reservoir for the storage of a quantity of disinfectant or deodorant liquid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
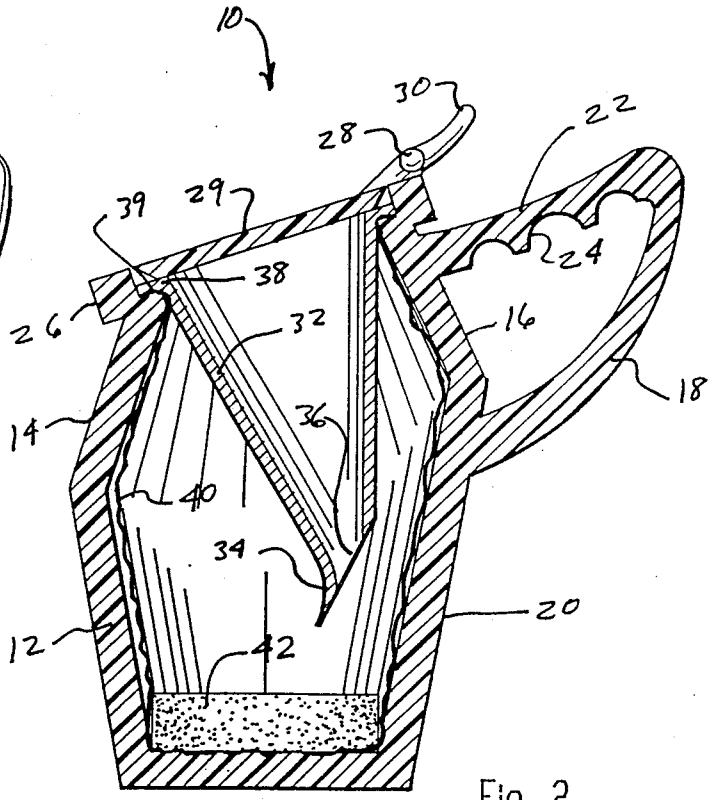
FIG. 1 is a side view of the portable spittoon according to a first embodiment of the present invention.

With reference now to the drawings, and in particular to FIG. 1 thereof, a new and improved portable spittoon embodying the principles and concepts of the present invention and generally designated by the reference numeral 10 will be described.

More specifically, it will be noted that the first embodiment 10 of the invention includes a hollow body member 12 which forms an open topped receptacle. A circular rim 26 surrounds a circular access opening which is disposed in an obliquely inclined plane. This orientation of the access opening, in conjunction with the securement of a first end 18 of a loop type handle on a first inclined side wall portion 20 and the securement of the second end 22 of the handle on an intersecting inclined side wall portion 16 of the receptacle 12 provides a convenient orientation with the access opening to the mouth of a user. The receptacle 12 has an upper frusto conical portion 14 having an obliquely inclined central longitudinal axis. The lower portion 20 of the receptacle 12 is in the form of a rectangular prism, having four upwardly and outwardly flaring side walls which are merged in a smooth curve with the upper frusto conical portion 14. The access opening has a pivotal cover which includes a thumb tab 30 secured by a pivot pin 28. The upper end 22 of the loop type handle may be provided with finger grooves 24, if so desired.

Figure 2:
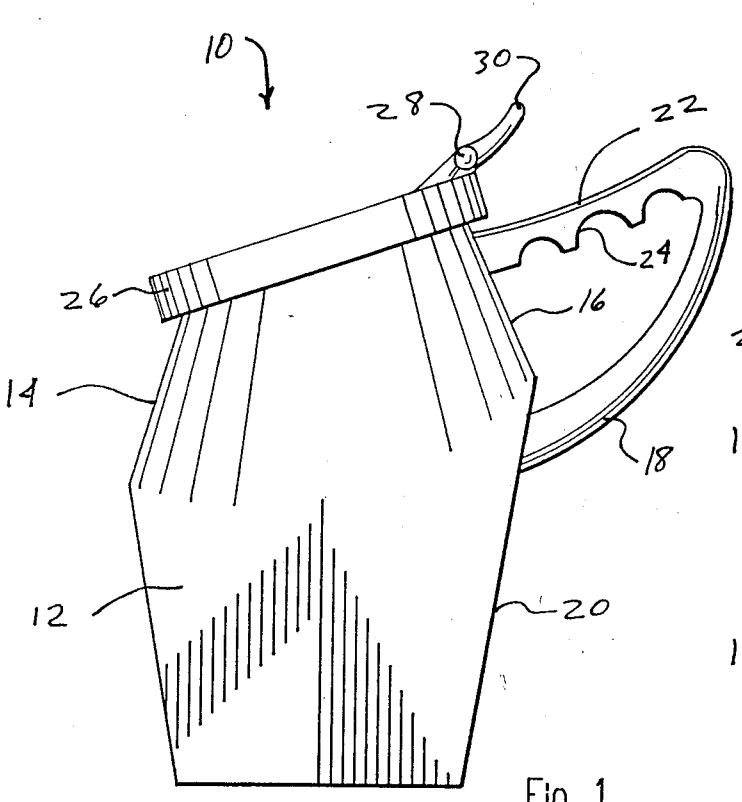
FIG. 2 is a longitudinal cross sectional view, illustrating the internal construction of the portable spittoon according to the first embodiment of the present invention.

As shown in the longitudinal cross sectional view of FIG. 2, the circular access opening is surrounded by a circular rim 26 and an internal recessed annular shoulder 39. The pivotal cover 29 may be selectively open and closed by depressing or releasing the thumb tab 30. The recessed annular shoulder 39 forms an abutment surface for a radially outwardly extending circular flange 38 formed at a top inlet end of a generally frusto conical funnel 32. An outlet end 36 of the funnel 32 is suspended within the interior of the receptacle or the hollow body member 12. An arcuate lip 34 is formed adjacent the outlet end 36 of the funnel 32, and serves to direct spittle to a central interior floor portion of the receptacle 12. A disposable plastic liner 40 has an upper peripheral edge clamped between the radial flange 38 and the annular shoulder 39. It is to be understood that the flange 38 is dimensioned to be snugly inserted within the access opening and to be securely frictionally retained therein. An absorbent material, such as a sponge 42, is secured, for example adhesively, on an interior floor portion of the disposable liner 40. As an alternative to the sponge 42, absorbent paper may be utilized. The sponge 42 is treated with a conventional deodorant and disinfectant material. In use, an individual chewing tobacco merely depresses the thumb tab 30 to open the pivotal cover 29 and then expectorates into the funnel 32 upon which the thumb tab 30 is released, thus closing the cover 29. The spittle travels by gravity through the funnel 32 and is directed by the arcuate lip 34 to the central portion of the sponge 42, where the spittle is absorbed, disinfected and deodorized. When the sponge 42 is saturated, the funnel 32 is removed and the liner 40 removed, sealed by an attached wire twist tie and discarded. The funnel and the interior of the receptacle 12 may then be washed, for example in a dishwasher.

Figure 3:
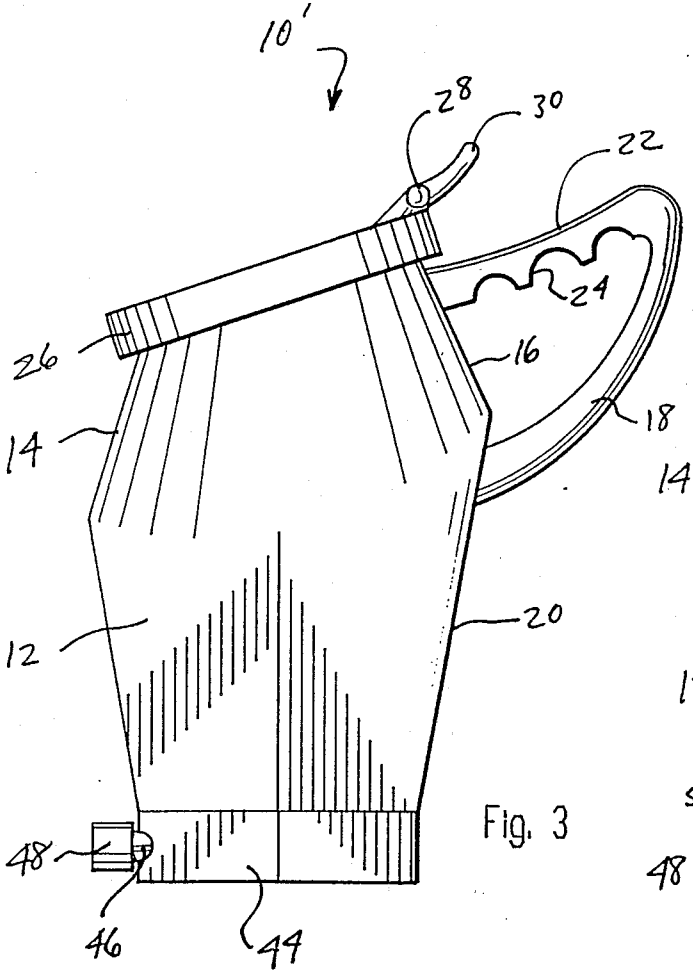
FIG. 3 is a side view of a slightly modified portable spittoon according to a second embodiment of the present invention.

FIG. 3 provides a side view of a slightly modified embodiment 10' according to the present invention. The device is identically formed as described with respect to the first embodiment illustrated in FIGS. 1 and 2, with the exception that a reservoir 44 for a disinfectant and deodorant liquid is removably secured to an exterior bottom portion of the receptacle 12. The reservoir 44 includes a filler neck 46 covered by a cap 48.

Figure 4:
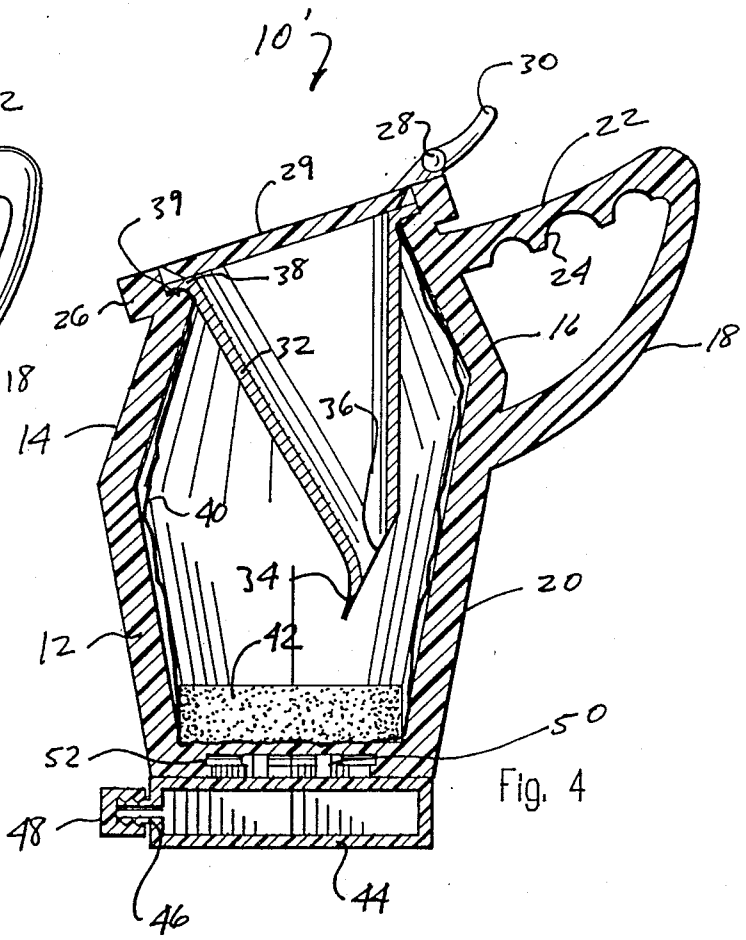
FIG. 4 is a longitudinal cross sectional view, illustrating the internal construction of the modified spittoon according to the second embodiment of the present invention.

As shown in the cross sectional view of FIG. 4, the upper exterior surface of the reservoir 44 is provided with a plurality of resilient projections 50 which are frictionally retained within cooperatively formed recesses formed in the bottom exterior surface of the receptacle 12.

Figure 5:
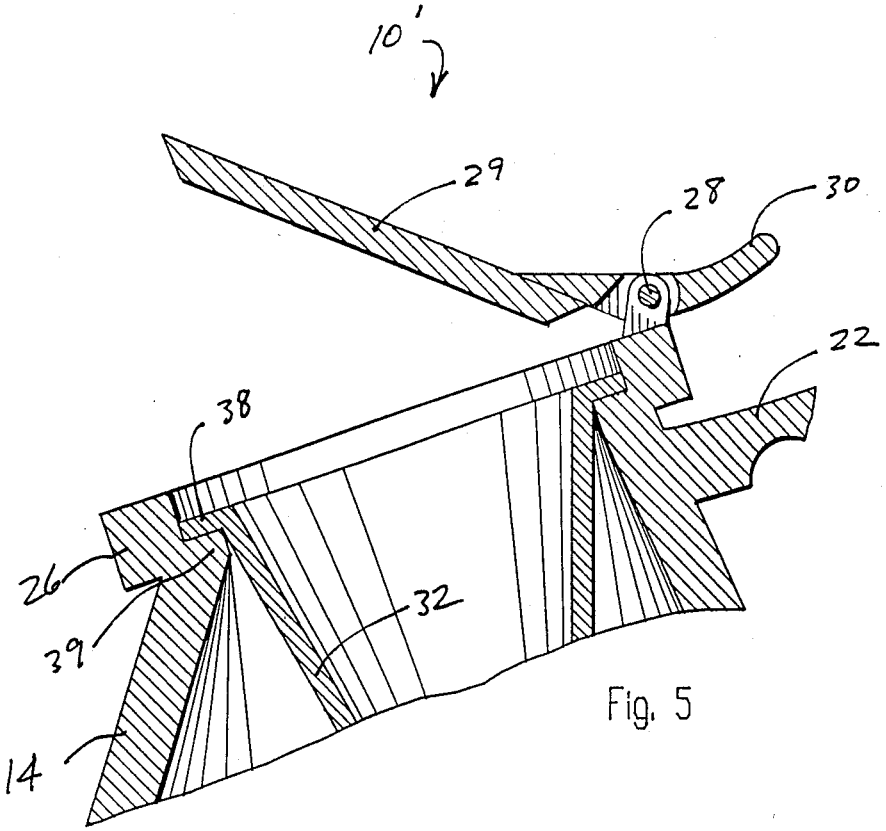
FIG. 5 is an enlarged partial cross sectional detail view, illustrating the construction of the pivotal thumb operated cover.

FIG. 5 provides an enlarged partial cross sectional detail view, which illustrates the engagement of the radial flange 38 of the funnel 32 on the annular recess shoulder 39 and also illustrates the construction of the pivotal cover 29.

Figure 6:
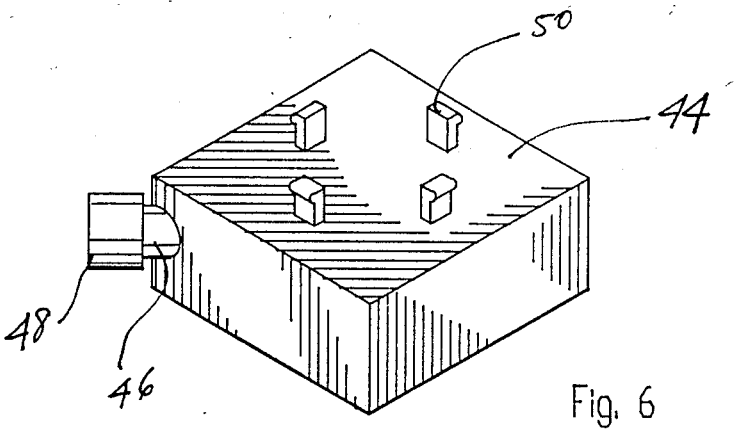
FIG. 6 is a perspective view illustrating the removable deodorant or disinfectant liquid reservoir.

FIG. 6 is a perspective view illustrating the configuration of the removable fluid reservoir 44. As previously described, a plurality of resilient projections 50 are provided on a top surface of the reservoir 44 for engagement with cooperating recesses formed in the bottom surface of the receptacle 12, as illustrated in FIG. 4. As may now be understood, the projections 50 on the reservoir 44 may be snapped into or out of the recesses in the bottom exterior surface of the receptacle 12. The reservoir 44 is utilized to store a quantity of a deodorant liquid for treating the interior of the receptacle 12, as required.

As may now be understood, with reference to the foregoing description, the present invention provides an easily affordable spittoon which allows tobacco chewers to dispose of their expectorate in a sanitary and socially acceptable fashion. The device utilizes disposable liners and is uniquely constructed with an ergonometric design to allow convenient use by tobacco chewing individuals.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the U.S. is as follows:

1. A portable spittoon, comprising:

an elongated hollow body member including a body portion;

an access opening formed in a top portion of said body member;

a funnel inserted through said opening, an outlet end of said funnel suspended within said hollow body member;

means for selectively closing and opening said access opening;

a substantially fluid reservoir receptacle for storing a deodorant and disinfecting liquid removably secured on the outside surface of said bottom portion of said hollow body members forming a base for the spittoon; and cooperating projections and recesses formed on said bottom portion of said hollow body member and on said fluid reservoir for frictionally retaining said reservoir on said outside surface of said bottom portion of said hollow body member.

2. The portable spittoon of claim 1, further comprising means for absorbing spittle within said hollow body member.

3. The portable spittoon of claim 2, wherein said absorbing means comprises a sponge.

4. The portable spittoon of claim 3, wherein said sponge is treated with a deodorant and a disinfectant.

5. The portable spittoon of claim 1, further comprising a disposable plastic liner received within said hollow body member.

6. The portable spittoon of claim 5, further comprising a sponge secured in an interior floor portion of said disposable plastic liner.

7. The portable spittoon of claim 6, wherein said sponge is treated with a deodorant and a disinfectant.

8. The portable spittoon of claim 1, wherein said means for selectively opening and closing said access openings comprise a pivotal cover actuated by a thumb tab.

9. The portable spittoon of claim 1, further comprising a handle on said body member.

10. The portable spittoon of claim 1, further comprising a recessed annular shoulder adjacent said access opening; and said funnel having a radially outwardly extending annular flange in engagement with said annular shoulder.

11. The portable spittoon of claim 10, further comprising a disposable liner having an upper peripheral edge clamped between said radial funnel flange and said annular shoulder.

12. The portable spittoon of claim 1, wherein said access opening is oriented in an obliquely inclined plane.

13. The portable spittoon of claim 1, wherein said outlet end of said funnel has an arcuately curved lip for directing spittle to a central interior floor portion of said hollow body member.

* * * * *